US009831076B2

(12) United States Patent
Kovtoun

(10) Patent No.: US 9,831,076 B2
(45) Date of Patent: Nov. 28, 2017

(54) ION INTERFACE DEVICE HAVING MULTIPLE CONFINEMENT CELLS AND METHODS OF USE THEREOF

(75) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 25 days.

(21) Appl. No.: 13/287,849

(22) Filed: Nov. 2, 2011

(65) Prior Publication Data

US 2013/0105681 A1 May 2, 2013

(51) Int. Cl.
*H01J 49/00* (2006.01)
*H01J 49/04* (2006.01)

(52) U.S. Cl.
CPC ..... *H01J 49/0045* (2013.01); *H01J 49/009* (2013.01); *H01J 49/0481* (2013.01)

(58) Field of Classification Search
CPC ..... H01J 49/06
USPC ..... 250/282
See application file for complete search history.

(56) References Cited

U.S. PATENT DOCUMENTS 5,572,035 A 11/1996 Franzen
5,783,824 A * 7/1998 Baba et al. ..... 250/281
5,847,386 A * 12/1998 Thomson et al. ..... 250/288
6,177,668 B1 * 1/2001 Hager ..... 250/282
6,483,109 B1 11/2002 Reinhold et al.
6,875,980 B2 4/2005 Bateman et al.
7,067,802 B1 * 6/2006 Kovtoun ..... 250/282
7,157,698 B2 * 1/2007 Makarov ..... H01J 49/004 250/281
7,385,187 B2 * 6/2008 Verentchikov et al. ..... 250/287
7,514,673 B2 * 4/2009 Senko et al. ..... 250/281
7,718,959 B2 5/2010 Franzen et al.
7,781,728 B2 * 8/2010 Senko et al. ..... 250/281
(Continued)

FOREIGN PATENT DOCUMENTS

WO 2013092923 A2 6/2013

OTHER PUBLICATIONS

Schwarz, S., "RF ion carpets: The electric field, the effective potential, operational parameters and an analysis of stability," International Journal of Mass Spectrometry 299 (2011), pp. 71-77.
(Continued)

*Primary Examiner* — Jason McCormack
*Assistant Examiner* — J Choi
(74) *Attorney, Agent, or Firm* — Charles B. Katz

(57) ABSTRACT

A device and associated method are disclosed for interfacing an ion trap to a pulsed mass analyzer (such as a time-of-flight analyzer) in a mass spectrometer. The device includes a plurality of separate confinement cells and structures for directing ions into a selected one of the confinement cells. Ions are ejected from the ion trap in a series of temporally successive ion packets. Each ion packet (which may consist of ions of like mass-to-charge ratio), is received by the ion interface device, fragmented to form product ions, and then stored and cooled in the selected confinement cell. Storage and cooling of the ion packet occurs concurrently with the receipt and storage of at least one later-ejected ion packet. After a predetermined cooling period, the ion packet is released to the mass analyzer for acquisition of a mass spectrum.

18 Claims, 8 Drawing Sheets

(56) References Cited

U.S. PATENT DOCUMENTS

| | | | | |
|---|---|---|---|---|
| 7,858,926 | B1 * | 12/2010 | Whitehouse et al. | 250/281 |
| 7,872,228 | B1 * | 1/2011 | Kim | H01J 49/423 250/287 |
| 2004/0065824 | A1 | 4/2004 | Bateman et al. | |
| 2004/0135080 | A1 * | 7/2004 | Ouyang et al. | 250/292 |
| 2008/0067349 | A1 | 3/2008 | Moskovets et al. | |
| 2009/0057553 | A1 | 3/2009 | Goodenowe | |
| 2009/0206248 | A1 * | 8/2009 | Makarov | H01J 49/06 250/283 |
| 2011/0240851 | A1 * | 10/2011 | Okumura et al. | 250/288 |
| 2011/0248162 | A1 | 10/2011 | Makarov et al. | |
| 2012/0193526 | A1 * | 8/2012 | Kovtoun | H01J 49/005 250/282 |

OTHER PUBLICATIONS

Bollen, G., ""Ion surfing" with radiofrequency carpets," International Journal of Mass Spectrometry 299 (2011), pp. 131-138.

* cited by examiner

105

ION INTERFACE DEVICE HAVING MULTIPLE CONFINEMENT CELLS AND METHODS OF USE THEREOF

FIELD OF THE INVENTION

The present invention relates generally to mass spectrometry, and more particularly to a device for energetically cooling packets of ions ejected from an ion trap prior to mass analysis.

BACKGROUND OF THE INVENTION

Tandem mass spectrometry, referred to as MS/MS, is a popular and widely-used analytical technique whereby precursor ions derived from a sample are subjected to fragmentation under controlled conditions to produce product ions. The product ion spectra contain information that is useful for structural elucidation and for identification of sample components with high specificity. In a typical MS/MS experiment, a relatively small number of precursor ion species are selected for fragmentation, for example those ion species of greatest abundances or those having mass-to-charge ratios (m/z's) matching values in an inclusion list. There is growing interest in the use of "all-mass" MS/MS, in which all or a substantial subset of the precursor ions are fragmented. All-mass MS/MS yields information-rich spectra and removes the need to select and isolate particular ion species prior to fragmentation. In order to simplify the interpretation of product ion spectra produced by all-mass MS/MS, the analysis may be conducted as a series of fragmentation/spectral acquisition cycles performed on different subsets or groups of the precursor ions, with each subset or group representing a different range of precursor ion m/z's. For example, if the precursor ions have m/z's ranging from 200 to 2000 Th, the first fragmentation/spectral acquisition cycle may be performed on a first packet of ions having m/z's between 200 and 210 Th, the second fragmentation/acquisition cycle may be performed on a second packet of ions having m/z's between 210 and 220 Th, and so on. U.S. Pat. No. 7,157,698 to Makarov et al., the disclosure of which is incorporated by reference, teaches a mass spectrometer architecture for implementing all-ion MS/MS with separation of the precursor ions into groups according to their m/z's. In the Makarov apparatus, an orthogonal-ejection two-dimensional ion trap is employed to eject m/z-grouped precursor ions into a collision cell, where the ions undergo fragmentation. The resultant product ions are transported to the entrance of a time-of-flight (TOF) mass analyzer for acquisition of a mass spectrum. TOF mass analyzers are particularly well-suited to all-mass MS/MS experiments due to their wide mass ranges and relatively short analysis times.

In the Makarov apparatus and similar designs employing an ion trap for mass-selective ejection, it is important to reduce the kinetic energy spread of the ejected ions, and product ions derived therefrom, prior to delivering the ions to the entrance of the mass analyzer. In TOF and other mass analyzers, high initial kinetic enlarge variations in the initial kinetic energies of the ions may significantly compromise measurement performance, particularly with respect to resolution and mass accuracy. Cooling of the ions to reduce kinetic energy and kinetic energy spread may be accomplished by directing the ions through a cooling region in which the ions lose energy via collisions with neutral gas molecules. Makarov uses an elongated collision cell structure with an axial DC gradient to provide the cooling region. The degree of energetic cooling will depend on the number of collisions experienced by the ions within the cooling region, which is governed by the product of residence time and cooling region pressure (t*P). For a cooling region held at a typical operating pressure, a total ion residence time of between 0.5-1.5 millisecond (ms) may be required to reduce ion kinetic energies to values that enable high-resolution mass analysis. This residence or cooling time may be substantially greater than the times required for ejection of an ion packet from the trap (as well as for mass analysis of an ion packet), which means that the ejection of a subsequent ion packet from the trap into the fragmentation/cooling region must be delayed until cooling of the first ion packet is completed. Differently expressed, the cooling period limits the rate at which the all-ion MS/MS analysis may be conducted and reduces the total number of analyses that may be performed during a chromatographic elution peak. Of course, the rate may be increased by employing a shorter cooling period, but doing so has a deleterious effect on resolution and/or mass accuracy.

SUMMARY

Briefly described, a mass spectrometer constructed and configured in accordance with embodiments of the invention includes an ion trap equipped to eject a series of ion packets in temporal succession, a pulsed mass analyzer such as a TOF mass analyzer, and an ion interface device positioned in the ion path between the ion trap and the pulsed mass analyzer. The ion interface device includes a transport/collision section and a plurality of spatially separated confinement cells. A packet of ions ejected from the ion trap is received by the ion interface device and directed to a selected one of the plurality of confinement cells. The ion packet is confined and cooled within the confinement cell for a prescribed cooling period, after which it is released to the pulsed mass analyzer for acquisition of a mass spectrum. Confinement and cooling of the ion packet in the ion interface device occurs concurrently with the receipt of one or more successively ejected ion packets, each of which is directed within the ion device to another one of the confinement cells. By enabling concurrent cooling of different ion packets in spatially separated confinement cells, the ions in each ion packet may be cooled sufficiently to enable the acquisition of mass spectra at high resolution in the pulsed mass analyzer, without having to substantially delay the ejection of a subsequent packet of ions from the ion trap until cooling of the previous packet is completed.

According to more particular embodiments of the invention, the ion interface device may cause at least a portion of the ions in each received ion packet to undergo fragmentation or reaction to form product ions. The ion interface device may include at least four confinement cells. The ion interface device may include a distribution section having an array of rod electrodes oriented transversely to the longitudinal axis of the ion interface device, with the confinement cells being disposed laterally outwardly of the rod electrodes. At least some of the rod electrodes may be segmented to enable development of a transverse DC field that moves an ion packet to the selected confinement cell. The TOF mass analyzer may include first and second ion flight paths having entrance regions respectively disposed proximate to first and second sets of the confinement cells. The first and second ion flight paths of the TOF mass analyzer may terminate at a common detector assembly. The product of the cooling period and the confinement cell pressure may be a minimum of 1 ms·mTorr, and preferably in the range of 2-5 ms·mTorr.

DETAILED DESCRIPTION OF EMBODIMENTS

Figure 1:
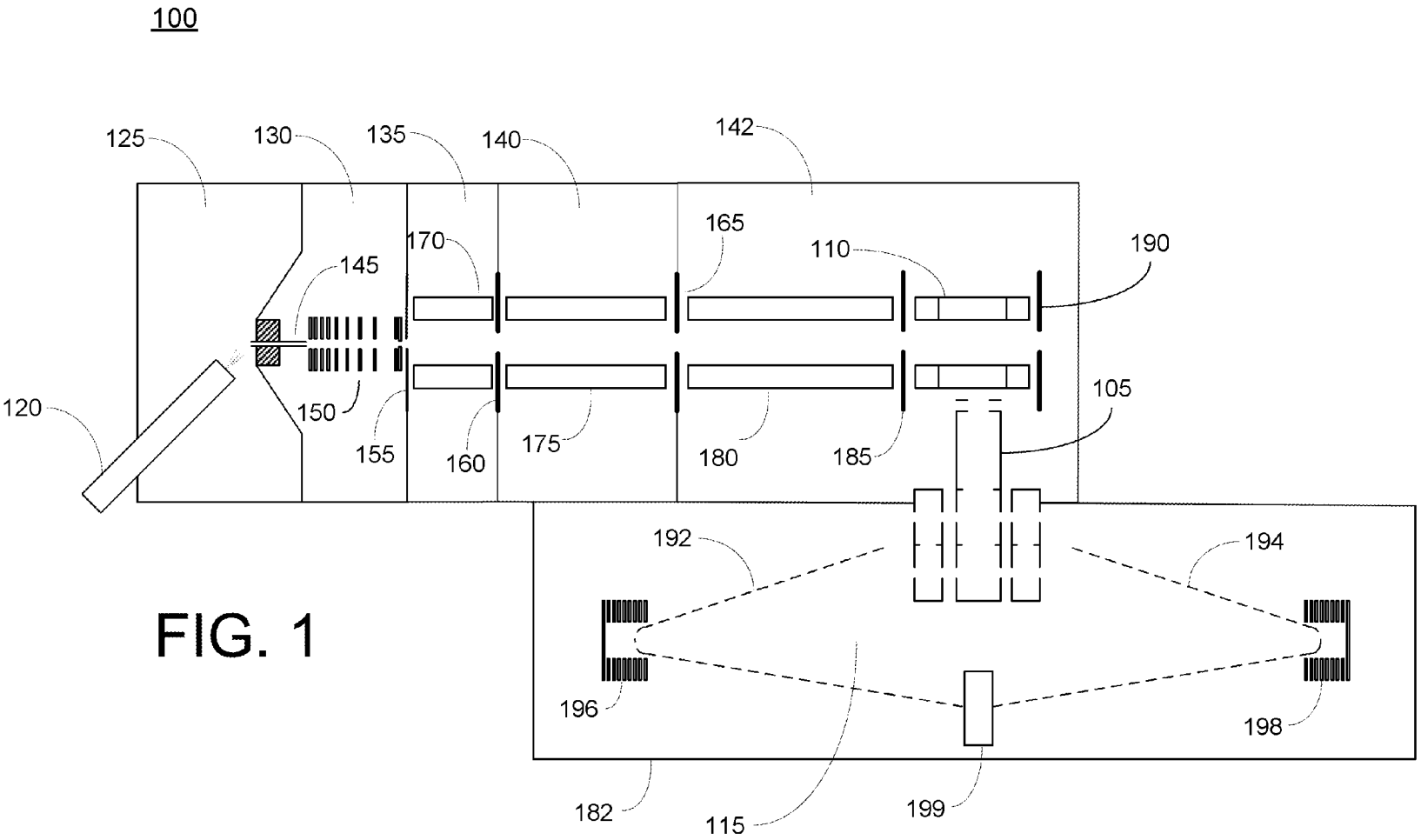
FIG. 1 is a symbolic diagram of a mass spectrometer configured according to an illustrative embodiment of the invention.

FIG. 1 depicts the components of a mass spectrometer 100 which includes an ion interface device 105 for cooling ions ejected from an ion trap 110 and transporting the ions to the inlet of a TOF mass analyzer 115, in accordance with an embodiment of the present invention. It will be understood that certain features and configurations of mass spectrometer 100 are presented by way of illustrative examples, and should not be construed as limiting the invention to implementation in a specific environment. An ion source, which may take the form of an electrospray ionization (ESI) source utilizing an ESI probe 120, generates ions from an analyte material, for example the eluate from a liquid chromatograph (not depicted). The ions are transported from ion source chamber 125, which for an ESI source will typically be held at or near atmospheric pressure, through several intermediate chambers 130, 135 and 140 of successively lower pressure, to a vacuum chamber 142 in which ion trap 110 resides. Efficient transport of ions from source chamber 125 to ion trap 110 is achieved by the use of suitable ion optical components, such as ion transfer tube 145, S-lens 150 (the design and operation of which is described in U.S. Pat. Nos. 7,514,673 and 7,781,728 to Senko et al.), electrostatic lenses 155, 160 and 165 and radio-frequency (RF) multipole ion guides 170, 175 and 180. Intermediate chambers 130, 135 and 140 and vacuum chambers 142 and 182 are evacuated by a suitable arrangement of pumps to maintain the pressures therein at the desired values. Ion trap 110 may be provided with axial trapping electrodes 185 and 190 (which may take the form of conventional plate lenses) positioned axially outward from the ion trap RF electrodes to assist in the generation of a potential well for axial confinement of ions, and also to effect controlled gating of ions into the interior volume of ion trap 110. A damping/collision gas inlet (not depicted), coupled to a source of an inert gas such as helium or argon, will typically be provided to controllably add a damping/collision gas to the interior of ion trap 110 in order to facilitate ion trapping, and cooling.

Ion interface device 105 is provided with a plurality of separate confinement cells. As will be discussed in greater detail below, ion interface device 105 receives individual packets of ions ejected from ion trap 110 and directs each ion packet to a selected confinement cell. The ion packet is held within the confinement cell for confinement period, during which time the ions undergo energetic cooling. As the ions in one ion packet cool in the associated confinement cell, one or more successively ejected ion packets are received by ion interface 105 and directed to other ones of the plurality of confinement cells. In a preferred embodiment, ion interface 105 includes a transport/collision section in which some or all of the ions in the incoming ion packet undergo fragmentation by collision activated dissociation (CAD) or other mechanism of dissociation to yield product ions.

After cooling for a predetermined confinement period, an ion packet is released from the associated confinement cell of ion interface device 105 to the inlet of TOF analyzer 115. As depicted in FIG. 1, TOF analyzer 115 may have first and second flight paths 192 and 194. First and second flight paths 192 and 194 have inlets positioned proximately to (respectively) first and second sets of confinement cells. As they travel along the flight path, ions are separated according to their mass-to-charge ratios (m/z's) by virtue of the dependence of ion velocity on m/z. Reflectors 196 and 198 may be provided to extend the lengths of the first and second flight paths, as well as to compensate for variations in the initial kinetic energies of the ions. A common detector system 199 located at the termination of the first and second flight paths may be used to detect ions and generate signals representative of the abundances of ions at particular values of m/z.

The operation of the various components of mass spectrometer 100 is directed by a control and data system (not depicted in FIG. 1), which will typically consist of a combination of general-purpose and specialized processors, application-specific circuitry, and software and firmware instructions. The control and data system also provides data acquisition and post-acquisition data processing services.

While mass spectrometer 100 is depicted as being configured for an electrospray ion source, it should be noted that other implementations may utilize any number of pulsed or continuous ion sources (or combinations thereof), including without limitation a matrix assisted laser desorption/ionization (MALDI) source, an atmospheric pressure chemical ionization (APCI) source, an atmospheric pressure photoionization (APPI) source, an electron ionization (EI) source, or a chemical ionization (CI) ion source. Furthermore, while embodiments of the invention are described herein with reference to a TOF mass analyzer, those of ordinary skill will appreciate that the interface device and method described herein may be beneficially utilized in connection with other types of pulsed mass analyzers, including but not limited to Orbitrap and other electrostatic trap mass analyzers, and Fourier Transform/Ion Cyclotron Resonance (FTICR) mass analyzers.

Figure 2:
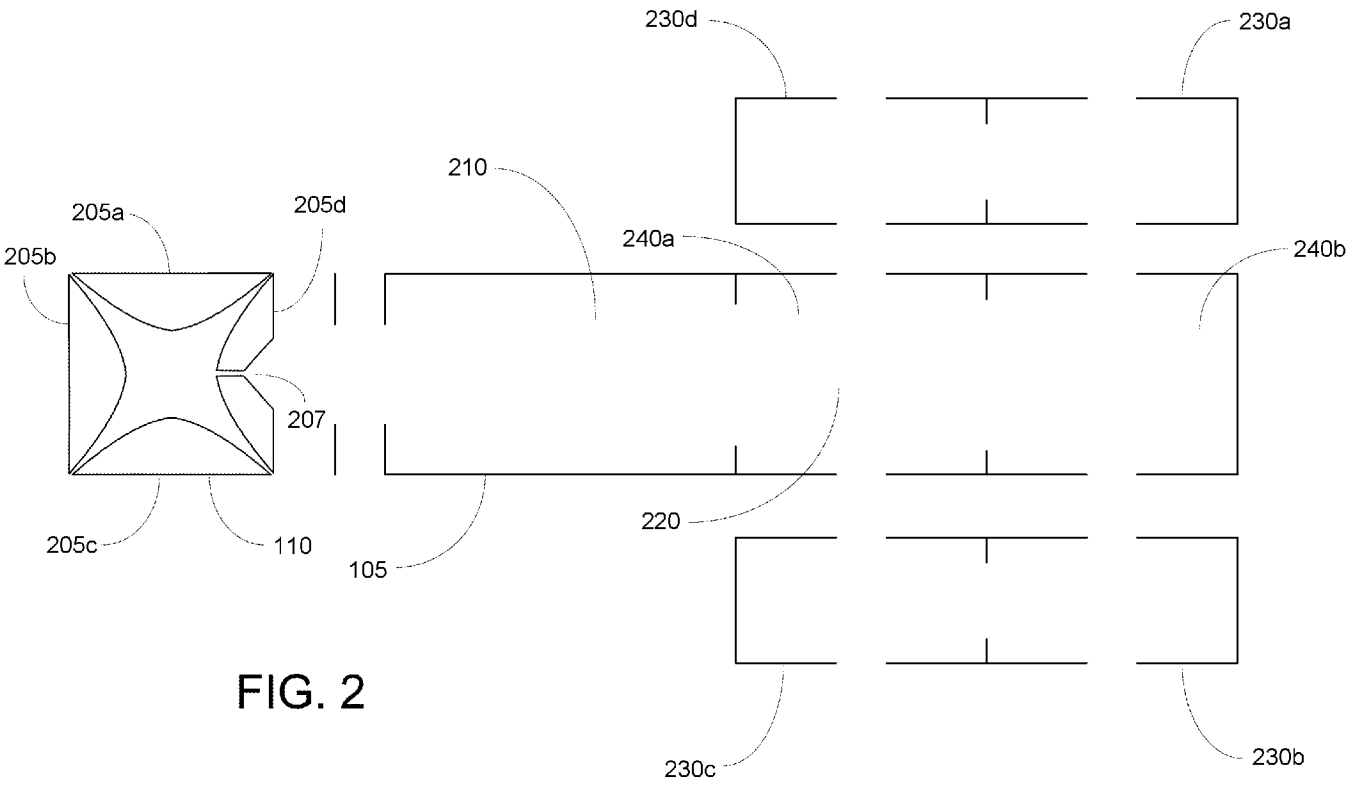
FIG. 2 is a symbolic diagram depicting in greater detail features of the ion interface device of the FIG. 1 mass spectrometer.

FIG. 2 is a symbolic side view of ion interface device 105 and ion trap 110. Ion trap 110 is preferably of the two-dimensional radial ejection type, and includes four axially elongated electrodes 205*a,b,c,d* arranged in mutually parallel relation about a centerline. Each electrode 205*a,b,c,d* has a truncated hyperbolic-shaped surface facing the interior volume of ion trap 110. In a particular implementation, each electrode is segmented into front end, central and back end segments, which are electrically insulated from each other to allow each segment to be maintained at a different DC potential. For example, the DC potentials applied to the front end and back end sections may be raised relative to the DC potential applied to the central sections to create a potential well that axially confines positive ions to the central portion of the interior of ion trap 110. At least one electrode 205*d* is adapted with an axially elongated aperture (slot) 207 that extends through the full thickness of the electrode to allow ions to be ejected therethrough in a direction that is generally orthogonal to the central longitudinal axis of ion trap 110. One or more of the remaining electrodes 205*b,c,d* may be adapted with surface features such as recesses or displaced from the ideal hyperbolic radius $r_0$ in order to minimize undesirable higher-order field components arising from the presence of aperture 207.

Electrodes 205,*a,b,c,d* (or a portion thereof) are coupled to an RF trapping voltage source, excitation voltage source, and DC voltage source (not depicted), all of which communicate with and operate under the control of a controller that forms part of the control and data system. The RF trapping voltage source is configured to apply RF voltages of adjustable amplitude in a prescribed phase relationship to pairs of electrodes 205*a,b,c,d* to generate a trapping field that radially confines ions within the interior of ion trap 110. The DC voltage source is operable to apply DC potentials to electrodes 205*a,b,c,d* or sections thereof to, for example, generate a potential well that axially confines ions within ion trap 110. The excitation voltage source applies an oscillatory excitation voltage of adjustable amplitude and frequency across at least one pair of opposed electrodes to create a dipolar excitation field that resonantly excites ions for the purposes of isolation of selected species, collision induced dissociation, and mass-sequential scanning. During a mass-sequential scan, the RF trapping voltage amplitude is progressively increased from a first value to a second value, which respectively correspond to the lowest and highest m/z ions to be ejected, while a resonant excitation voltage is applied across electrodes 205*b,d*. This causes the ions to become resonantly excited and ejected from ion trap 110 (via aperture 207) in order of their m/z's. For all-mass MS/MS operation, the mass sequential scan is broken into a number of scan periods or windows, during each of which a packet of ions within a relatively narrow range of m/z's is ejected to ion transfer device 105. In one illustrative example, a mass sequential scan representing a total interval (difference between lightest and heaviest ions ejected) of 600 Th may be broken into 100 component scan windows, each representing an m/z range of 6 Th. For a typical mass-sequential scan rate of 16,000 Th/s, each scan window requires 6/16,000=375 μs to complete. Since this time may be significantly shorter than the time required for fragmentation and cooling (at typical operating pressures) of the ejected ions prior to analysis in a TOF mass analyzer, delaying the ejection of a packet of ions until the previously ejected group is fully cooled and fragmented would substantially increase the total analysis cycle time and reduce throughput. The utilization of ion interface device 105 avoids the need to delay ejection of a packet of ions pending completion of cooling and fragmentation of a previous group, as described below.

The design and operation of the ion trap described above is presented only by way of example, and should not be construed as limiting the scope of the invention. Other ion trap configurations (including two-dimensional quadrupole ion traps adapted for mass-selective axial ejection of ions through a barrier field, an example of which is described in U.S. Pat. No. 6,177,668 to Hager) may be used in place of the radial-ejection two-dimension ion trap disclosed above and depicted in the drawings.

Generally described, ion interface device 105 includes a transport/collision section 210, a distribution section 220, and four separate confinement cells 230*a*, 230*b*, 230*c* and 230*d*. An ion packet ejected from ion trap 110 enters ion interface device 105 through an inlet to transport/collision section 210. Transport/collision section 210 may be filled with a neutral collision/damping gas, such as argon, to induce fragmentation (which results from the collisions of energetic ions with atoms or molecules of the collision/damping gas, causing transfer of kinetic energy to excited vibrational modes of the ions). Concurrently, collisions remove kinetic energy from the incoming ions and product ions derived therefrom. If fragmentation of the incoming ions is desired, the conditions at which ions are resonantly ejected from ion trap 110, the DC potentials applied to electrodes of ion trap 110 and interface device 105 (as well as any intermediate lenses or other ion optics) and the composition of the collision/damping gas are selected such that the kinetic energies of the ions are sufficiently high to cause a substantial portion of the ions to undergo collisionally activated dissociation and produce product ions. In alternative implementations, product ions may be formed by filling transport/collision section 210 with reagent ions or molecules that react with sample ions in the ion packet. Typical collision/damping gas pressure within transport/collision section 210 will be in the range of 10-15 mTorr.

While FIG. 2 depicts transport/collision section and distribution section as being contiguous and integrated into a common structure, other embodiments of the interface device may implement the transport/collision section and distribution section as physically separate spaced-apart structures.

The ion packet (inclusive of any product ions) traverses transport/collision section 210 and enters distribution section 220. Movement of ions through transport/collision section 210 into distribution section 220 may be assisted by use of a longitudinal DC gradient, which may be established by the application of suitable DC potentials to electrodes of interface device 105 (including the main RF electrodes and/or any auxiliary electrodes). Within distribution section 220, ions of the ion packet are routed to an available (i.e., empty) confinement cell. Generally, routing of ions to a selected confinement cell will occur in a repeated fixed sequence. For example, a first-in-time ion packet may be routed to confinement cell 230*a*, a second-in-time ion packet may be routed to confinement cell 230*b*, a third-in-time ion packet may be routed to confinement cell 230*c*, and a fourth-in-time ion packet may be routed to confinement cell 230*d*. The timing and sequence of filling and emptying the confinement cells is discussed below in greater detail in connection with FIGS. 3A-E.

Routing of an ion packet to the destination confinement cell may be effected by the application of suitable DC potentials to electrodes within distribution region 220 to produce DC fields in the longitudinal and transverse dimensions that urge the ions toward the confinement cell. In a particular implementation, DC potentials may be applied to electrodes of distribution section 220 to establish a longitudinal potential well that confines ions to the front portion 240*a* or rear portion 240*b* of distribution section 220. A transverse DC field may be generated to cause the ions to travel in the transverse direction leading toward the selected confinement cell. As will be discussed in further detail below in connection with FIG. 6, the transverse field may be established by segmentation of at least a portion of the rod electrodes of distribution section 220 and application of suitable DC offsets to the different rod segments.

Figure 3A:
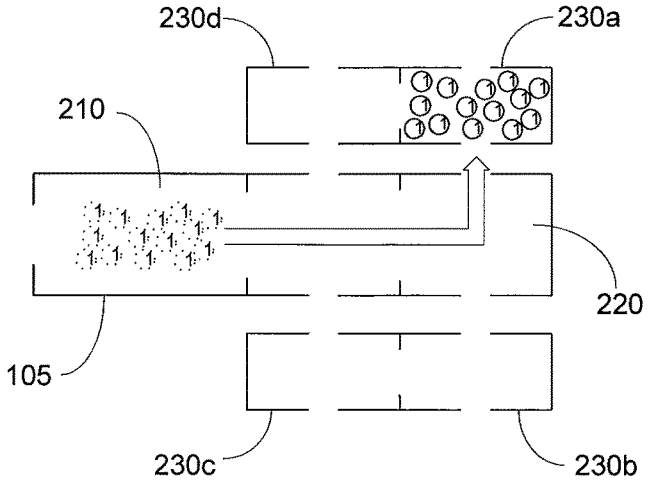
FIGS. 3A-3E are a series of symbolic diagrams depicting the storage of successively ejected ion packets in different confinement cells of the interface device.

Each ion packet is confined in the corresponding confinement cell for a confinement period of adequate duration to reduce the ions' kinetic energies to values that permit acquisition of a mass spectrum at high resolution and mass accuracy. As set forth in the background section, the amount of ion cooling will be a function of the product of confinement cell pressure and confinement period. In exemplary implementations, ion interface device is operated to provide a product of confinement cell pressure and confinement period of at least 1 ms·mTorr, and more preferably in the range of 2-5 ms·mTorr. For a typical confinement cell pressure of about 1.5 mTorr, the foregoing values translate to a confinement period of at least approximately 650 μs, and more preferably in the range of about 1300-3300 μs. After an ion packet has been confined in the confinement cell for the prescribed confinement period, the ion packet is released through the confinement cell outlet to TOF mass analyzer 115. Release of an ion packet from the confinement cell may be performed by applying or changing DC potentials on electrodes associated with the confinement cell. As depicted in FIG. 1, TOF analyzer 115 may include two ion flight paths 192 and 194 having inlets respectively positioned proximate to confinement cells 230*a,d* and 230*b,c*. Ions in the released packet travel along the corresponding flight path and arrive at detector 199 in order of their m/z's FIGS. 3A-3E illustrates the sequence of movement and storage of successively ejected ion packets through and in ion interface device 105. In FIG. 3A, a first ion packet (labeled "1"), which may represent ions within a first narrow range of m/z's, is ejected from ion trap 110 and is received within collision/transport section 210 through the ion interface device inlet. As discussed above, a portion of the incoming ions may undergo fragmentation via collisionally activated dissociation to form product ions. The first ion packet is passed to distribution region 220 and routed into first confinement cell 230*a* for storage and reduction of the ions' kinetic energy and energy spread. As used herein, the term "ion packet" refers to a group of ions ejected from the ion trap (or other structure capable of ejecting groups of ions) and received by ion interface 105 and any product ions derived from (e.g., by CAD or other dissociation technique) the received group of ions. Routing and storage of the first ion packet may be accomplished by the application of suitable DC potentials to electrodes of ion interface device 105, as described above.

Figure 3B:
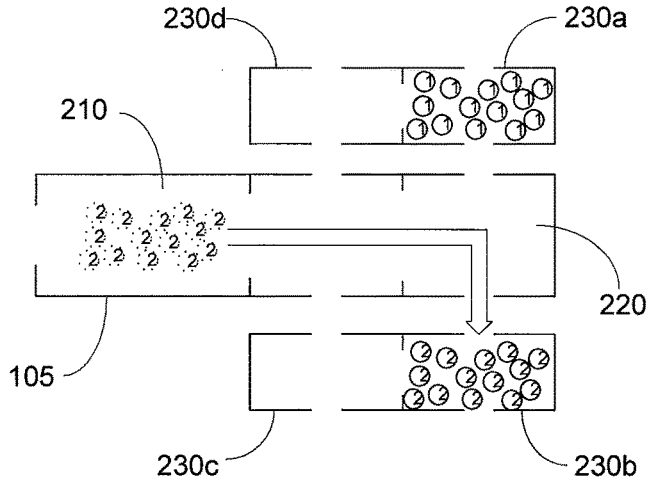

FIG. 3B depicts the reception and storage by ion interface device 105 of a second ion packet (labeled "2"), which may represent ions within a second narrow range of m/z's. Ions in the second ion packet are received in collision/transport section 220, optionally fragmented, and passed to distribution section 220 for routing into second confinement cell 230*b*. As illustrated, the reception and routing of the second ion packet occurs concurrently with the cooling of the first ion packet in confinement cell 230*a*.

Figure 3C:
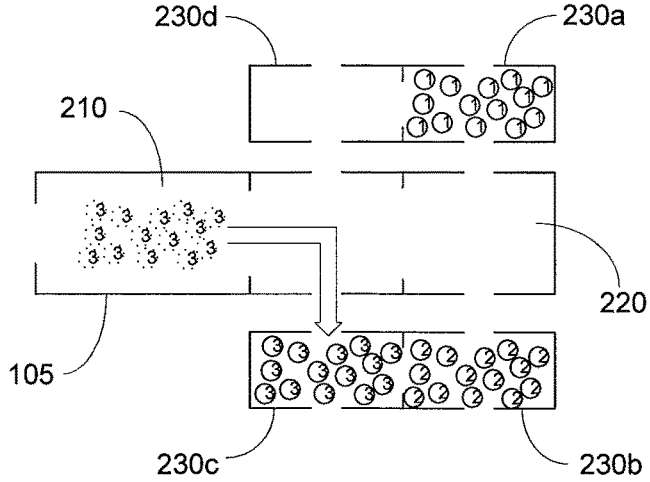

FIG. 3C depicts the reception and storage by ion interface device 105 of a third ion packet (labeled "3"), which may represent ions within a third narrow range of m/z's. Ions in the third ion packet are received in collision/transport section 210, optionally fragmented, and passed to distribution section 220 for routing into third confinement cell 230*c*. As illustrated, the reception and routing of the third ion packet occurs concurrently with the cooling of the first and second ion packets in (respectively) confinement cells 230*a* and 230*b*.

Figure 3D:
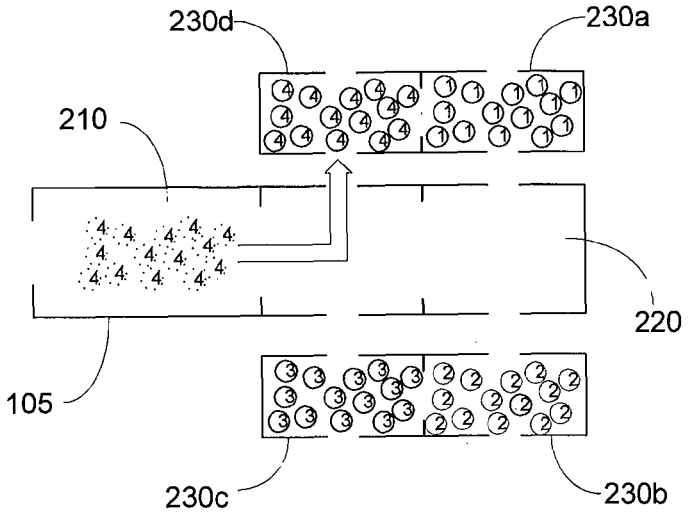

FIG. 3D depicts the reception and storage by ion interface device 105 of a fourth ion packet (labeled "4"), which may represent ions within a fourth narrow range of m/z's. Ions in the fourth ion packet are received in collision/transport section 210, optionally fragmented, and passed to distribution region 220 for routing into fourth confinement cell 230*d*. As illustrated, the reception and routing of the fourth ion packet occurs concurrently with the cooling of the first, second and third ion packets in (respectively) confinement cells 230*a*, 230*b* and 230*c*.

Figure 3E:
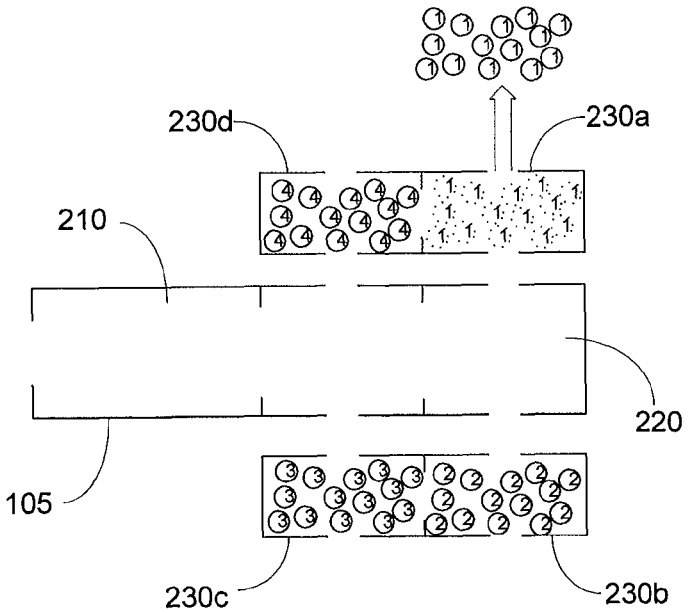

FIG. 3E depicts the release of the first ion packet from first confinement cell 230*a* to TOF analyzer 115. The release of the ion packet may be effected by adjusting DC potentials applied to electrodes defining first confinement cell 230*a* to remove the confining potential well. Once the ion packet is emptied from confinement cell 230*a*, it becomes available to store a subsequently ejected ion packet, e.g., a fifth ion packet. The maximum confinement period of an ion packet within the associated confinement cell, i.e., the longest the ion packet may be retained within the confinement cell before the confinement cell must be emptied to accept an ion packet subsequently ejected from ion trap 110, will be a function of the scan window duration (the amount of time required to scan out an ion packet of a specified m/z width from ion trap 110) and the number of confinement cells.

Figure 4:
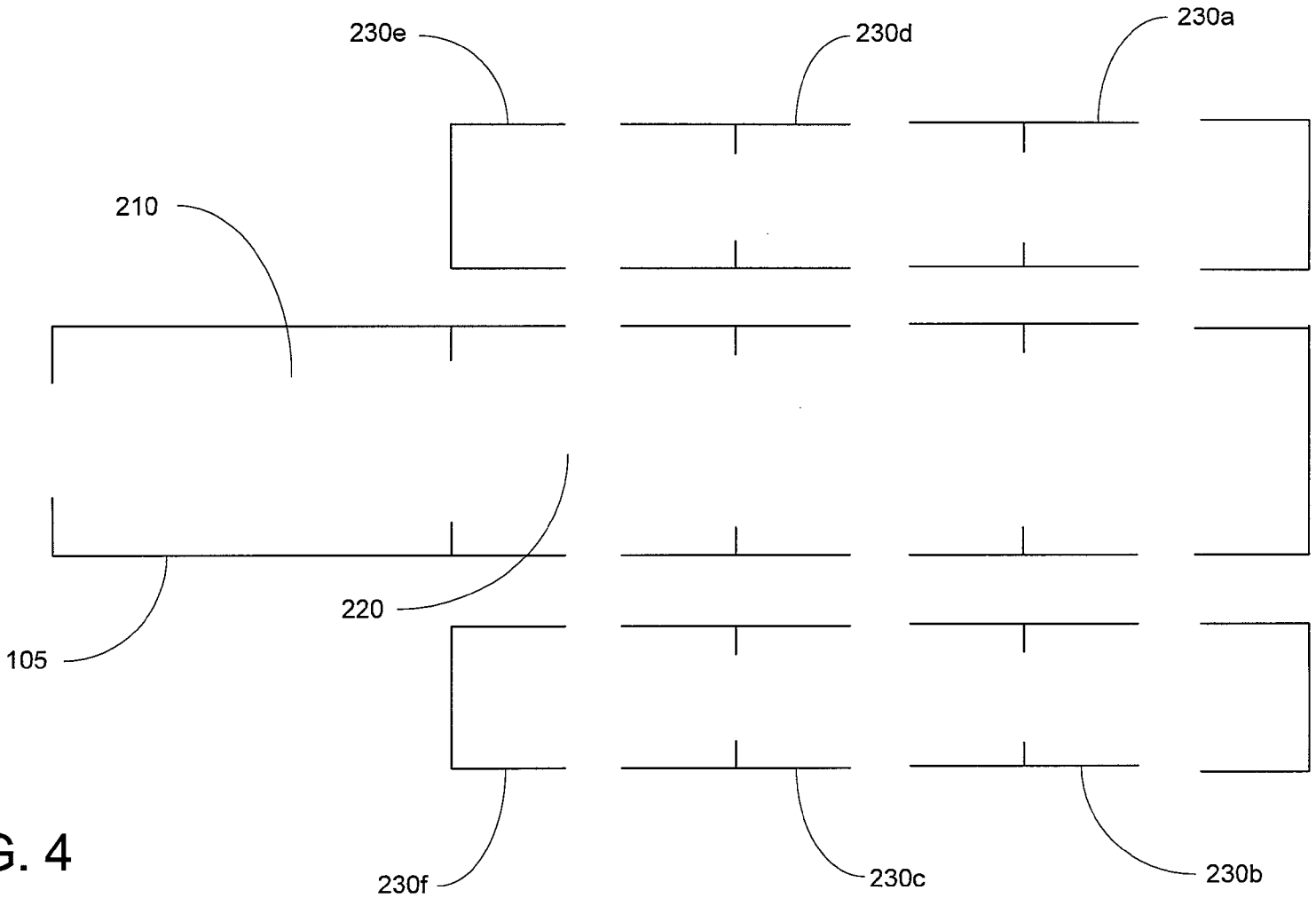
FIG. 4 is a symbolic diagram of another embodiment of the ion interface device having six confinement cells.
Figure 5A:
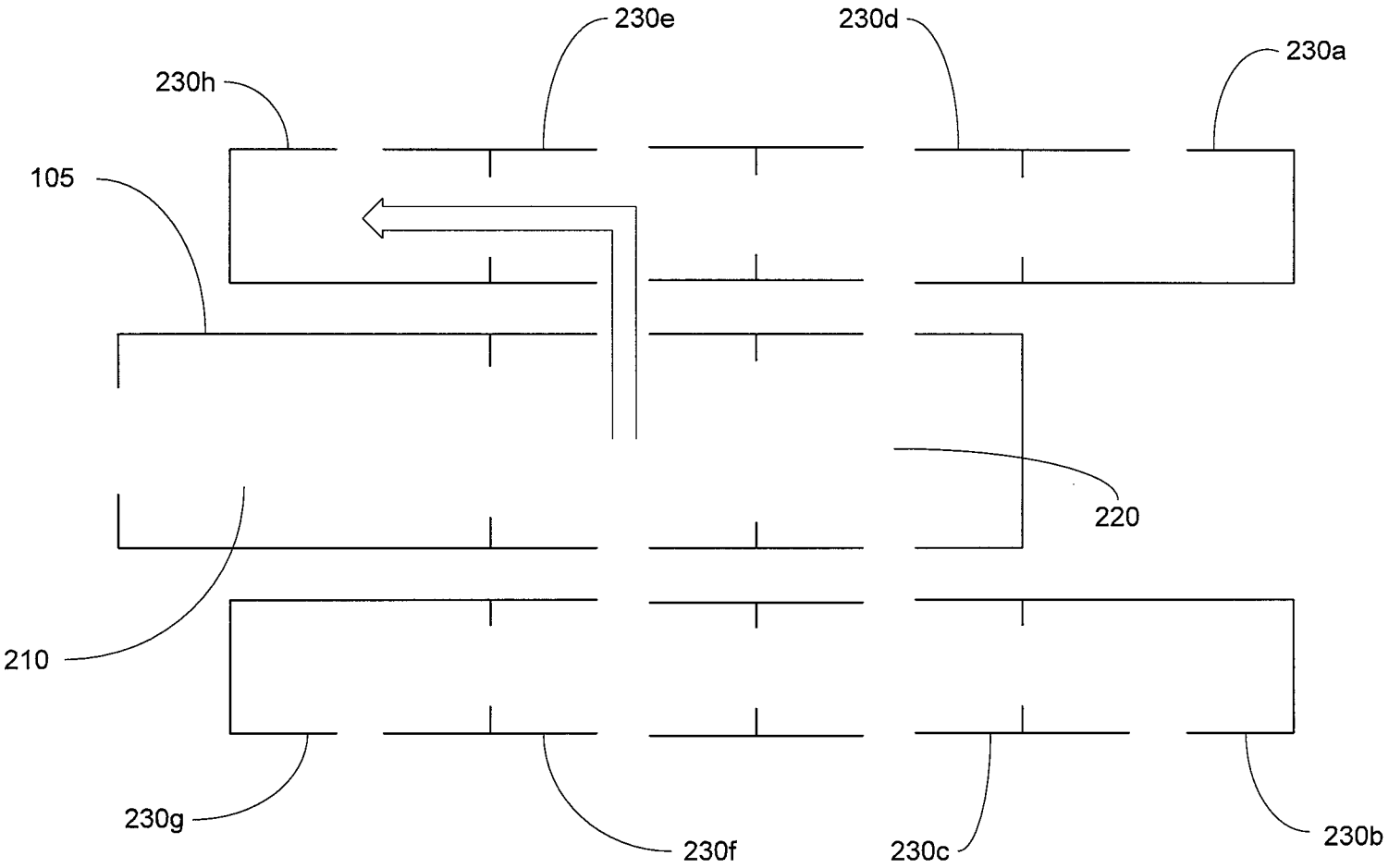
FIGS. 5A and 5B are symbolic diagrams of yet other embodiments of the ion interface device having eight confinement cells.
Figure 5B:
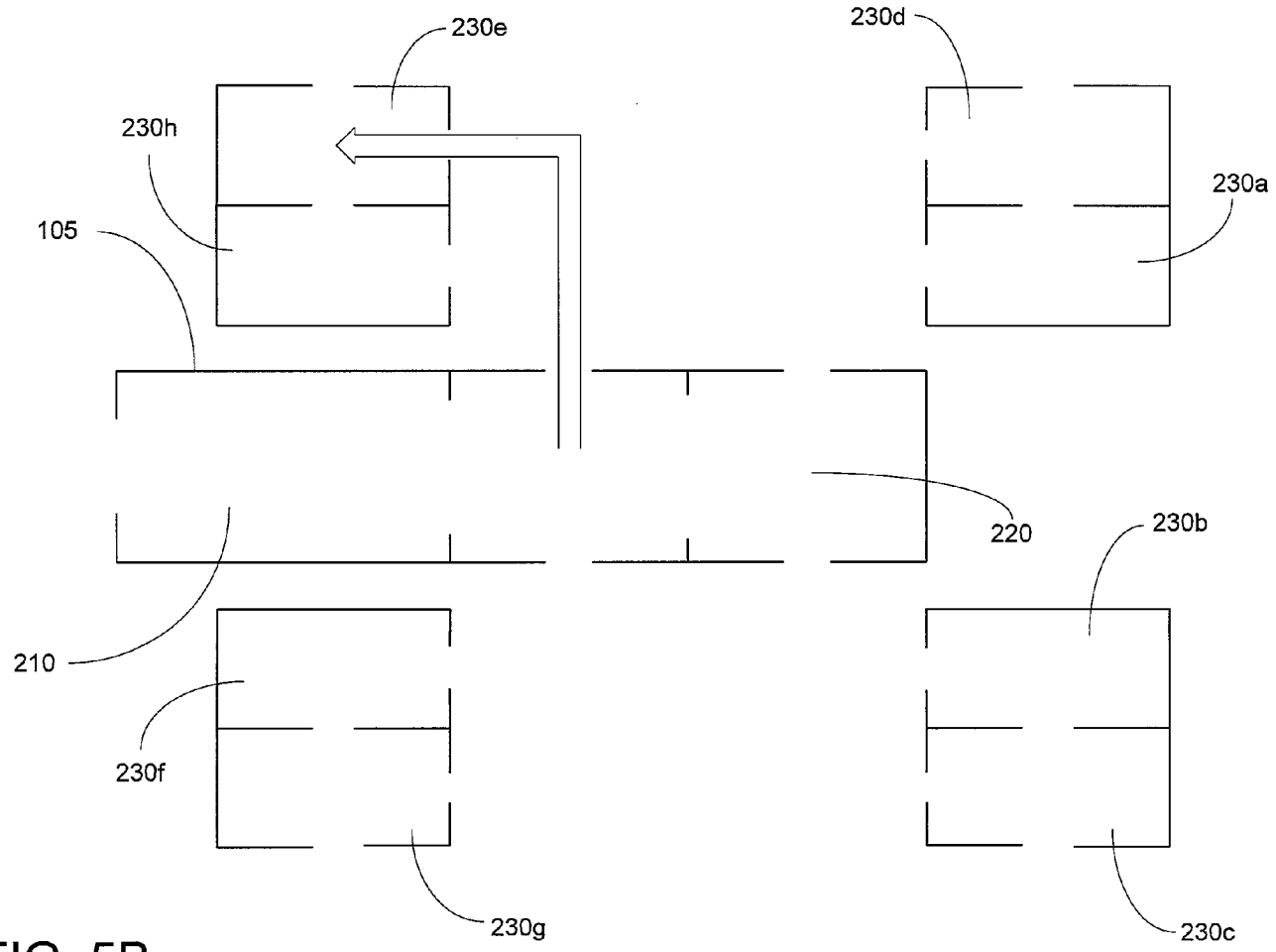

While ion interface 105 is described and depicted as having four confinement cells, other implementations may utilize a lesser or greater number of confinement cells. In particular, the maximum confinement period of an ion packet in the ion interface device can be extended by increasing the number of confinement cells. FIGS. 4 and 5 depict alternative embodiments of ion interface device 105 having greater numbers of confinement cells respectively. The FIG. 4 embodiment includes six confinement cells labeled 230*a-f*. Distribution region 220 has six outlets, each adjacent to one of the confinement cells, and is divided into thirds to enable establishment of a longitudinal potential well in a location corresponding to the selected confinement cell. The FIG. 5A embodiment includes eight confinement cells labeled 230*a-h*. However, distribution region 220 has only four outlets, whereby each outlet is associated with two confinement cells. The ion paths leading to certain of the confinement cells (230*a,b,g,h*) extend through other of the confinement cells; for example, as indicated by the arrow, the path of ions from distribution 220 to confinement cell 230*h* passes through confinement cell 230*e*. In this arrangement, the filling of confinement cells 230*a,b,g,h* require the prior emptying of the corresponding adjacent confinement cell in order to avoid mixing of the ion packets. This limitation may be avoided by "stacking" the confinement cells, as depicted in FIG. 5B, such that the ion path from distribution section 220 to the destination confinement cell does not extend through any other confinement cell.

Following the emptying and refilling of confinement cell 230*a*, each of the other confinement cells is emptied and refilled in the sequence described above. This sequence is repeated until the analytical scanning of the ion trap is terminated (or until another specified termination point has been reached), and all ion packets have been mass analyzed in TOF mass analyzer 115.

It will be recognized that each transfer of ion packets within ion interface is not instantaneous, but instead will require a finite time to complete. However, the applicant has found (via detailed computer modeling of ion motion during transfer operations), that the aggregate transfer time is significantly shorter than the confinement period required for adequate energetic cooling, and will typically comprise about ten percent of the total residence time within interface device 105.

Figure 6:
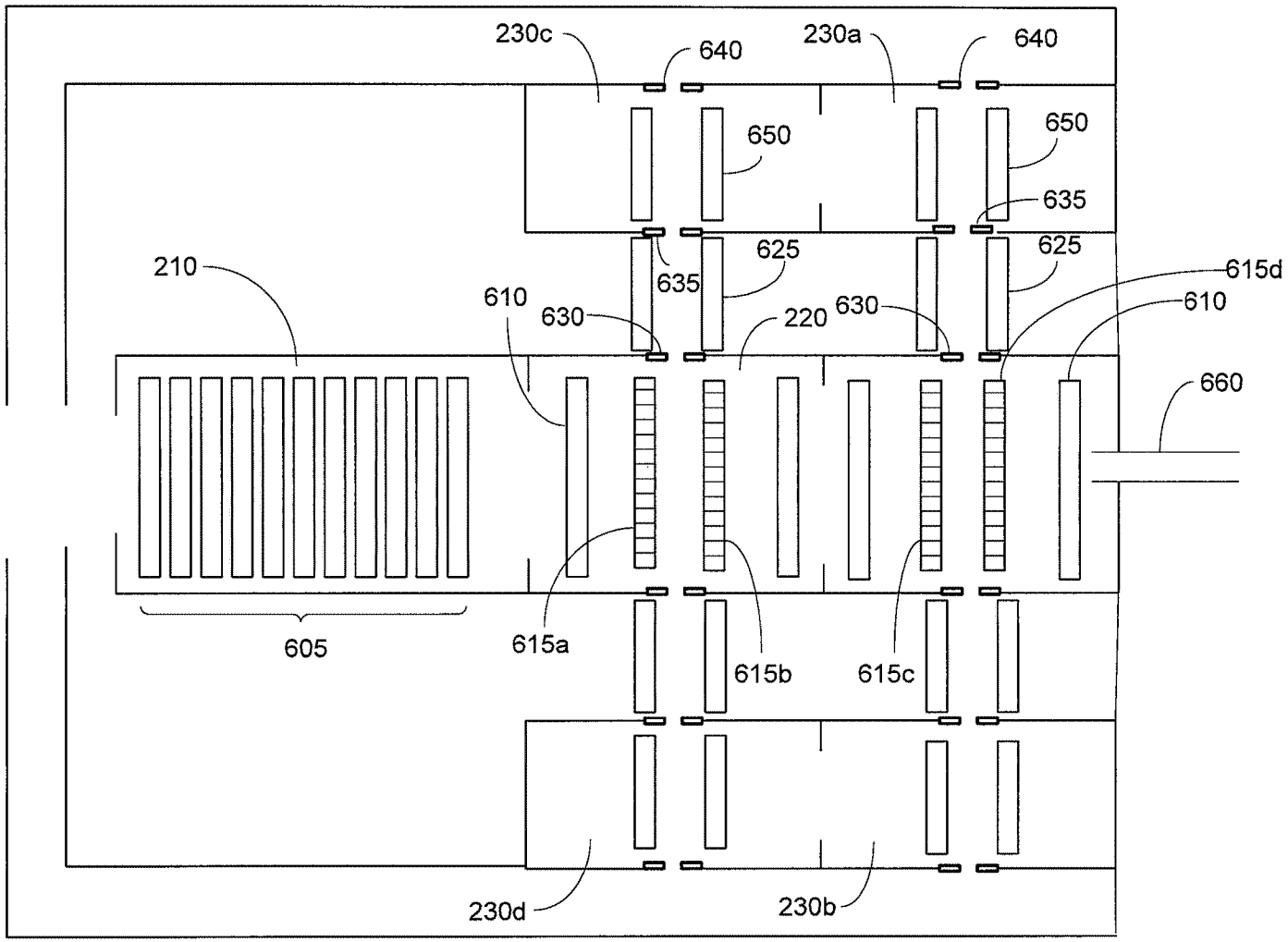
FIG. 6 is a symbolic diagram illustrating a particular implementation of the ion interface device shown in FIG. 2.

FIG. 6 depicts a particular implementation of the ion interface device 105 shown in FIG. 2. The ion interface device comprises sets of elongated rod electrodes, arranged in two parallel planes (one of which is shown in the figure, with the second lying above or below the depicted plane).

Transport/collision section 210 is provided with rod electrodes 605 oriented transversely to the major longitudinal axis of interface device 105 (along which ions are injected and initially travel) and positioned in spaced apart relationship along the major axis. An RF source (not depicted) applies RF potentials in a prescribed phase relationship to electrodes 605, whereby each electrode receives an RF potential that is 180 degrees out of phase with respect to the adjacent and opposing (across the plane normal to the drawing) electrodes. This establishes an RF field to confine ions traveling along the longitudinal axis. DC fields may be effected along the longitudinal axis by applying suitable DC potentials (supplied from a not-depicted DC source) to electrodes 605 in order to first decelerate and confine ions in the region where they undergo fragmentation, and thereafter transfer ions into distribution section 220.

Another set of rod electrodes 610, oriented transversely to the major longitudinal axis of ion interface device 105, is positioned within distribution section 220. Each electrode 610 receives an RF potential of a phase opposite to the adjacent and opposing electrodes to establish the confining RF field. Certain rod electrodes 615*a,b,c,d* (which also receive RF potentials) are segmented to allow different DC potentials to be applied to discrete segments of each rod, such that a DC potential gradient may be created along the transverse axis defined by the dimension of elongation of the rod electrodes. The transverse DC potential gradient is controlled (by adjustment of the potentials applied to the segments) to cause an ion packet to travel in the direction of the destination confinement cell; for example, DC potentials may be applied to segments of rod electrodes 615*a* and 615*b* to produce a DC gradient that directs ions toward confinement cell 230*c* or 230*d*. Of course, the segments may all be maintained at the same DC potential if no transverse DC field is to be established; for example, in the case where an ion packet is to be directed to one of confinement cells 230*a* or 230*b*, the segments of rod electrodes 615*a* and 615*b* may be maintained at the same DC potential such that ions passing through the region defined by these rods are not transversely deflected toward confinement cell 230*c* or 230*d*.

Those skilled in the art will recognize that the transverse DC potential gradients may be controllably established using techniques other than segmentation of the rod electrodes. For example, the rod electrodes may be surface coated with a resistive material, with different DC potentials applied to opposite ends of the rod electrodes, as described in U.S. Pat. No. 5,847,386 to Thomson et al. (the disclosure of which is hereby incorporated by reference). Alternatively, as also described in the aforementioned Thomson et al. patent DC potentials may be applied to auxiliary electrodes positioned around or between the rod electrodes. In another alternative, a helical conductive path may be disposed on the surface of the rod electrodes, with different DC potentials applied to the ends of the helical path, as described in U.S. Pat. No. 7,067,802 to Kovtoun, which is also incorporated by reference.

Ions travel from distribution section 220 to the destination confinement cell through an intermediate chamber in which are disposed rod electrodes 625, which are grouped into multipole structures having central axes extending between an outlet of distribution section 220 and a corresponding confinement cell. RF potentials may be applied to rod electrodes 625 in an alternating phase pattern, such that each multipole acts as an RF ion guide and radially confine the movement as ions as they travel therethrough.

Electrostatic lenses 630, 635 and 640, which may take the form of plate lenses, are located at (respectively) the outlet apertures of distribution section 220 and the inlet and outlet apertures of confinement cells 230*a,b,c,d*. Suitable DC voltages may be applied to the electrostatic lenses (from the not-depicted DC source) to selectively block or permit the movement of ion packets out of distribution section 220 and into the destination confinement cell, to axially confine ions within a confinement cell, and to eject ions from the confinement cell to the mass analyzer.

Each confinement cell is provided with a set of rod electrodes 650. Ions may be axially confined within the confinement cell by applying appropriate DC potentials to the corresponding lenses located at the inlet and outlet of the confinement cell. Following completion of the prescribed confinement period, the ion packet is ejected from its confinement cell by adjusting the DC potentials applied to outlet lens 640 and/or to rod electrodes 650.

Gas is controllably supplied to the interior of ion interface device 105 from a not-depicted external source through conduit 660. The gas, which will typically comprise an inert gas such as argon, removes kinetic energy from the incoming ions via collisions and induces (if desired) collisionally activated dissociation. Ion interface device 105 is located in one or more vacuum chambers that are evacuated by means of a suitable pump. The distribution outlet apertures (at which lenses 630 are located) and confinement cell inlet and outlet apertures (at which lenses 635 and 640 are respectively located) may be conductance limiting to allow the confinement cells to be maintained at a reduced pressure relative to the transport/collision and distribution sections. In an illustrative implementation, transport/collision section 210 and distribution section 220 are maintained at a pressure of about 13 mTorr, the intermediate section (interposed between distribution section 220 and the confinement cells) is maintained at a pressure of about 6 mTorr, and confinement cells 230*a,b,c,d* are maintained at a pressure of about 1.5 mTorr.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A mass spectrometer, comprising:

an ion trap configured to eject first and second packets of ions in temporal succession;

at least one pulsed mass analyzer for separating ions according to their mass-to-charge ratios to acquire a mass spectrum; and an ion interface device having a transport/collision region and a plurality of spatially separated ion confinement cells, the ion interface device being configured to:

receive the first packet of ions ejected from the ion trap, to cause at least a portion of the ions in the first ion packet to undergo fragmentation or reaction, and to route the first ion packet to a first ion confinement cell of the plurality of ion confinement cells; and while the first ion packet is still confined within the first ion confinement cell, to receive the second packet of ions ejected from the ion trap, to cause at least a portion of the ions in the second ion packet to undergo fragmentation or reaction, and to route the second ion packet to a second ion confinement cell of the plurality of ion confinement cells;

wherein the first packet of ions is routed to the first ion confinement cell without passing through the second confinement cell, and further wherein the second packet of ions is routed to the second confinement cell without passing through the first confinement cell;

the ion interface device being configured to release each ion packet to the at least one pulsed mass analyzer after the packet has been confined in the ion confinement cell for a prescribed confinement period, wherein the first and second ion confinement cells release ions to a common pulsed mass analyzer.

2. The mass spectrometer of claim 1, wherein the ion interface device includes at least four confinement cells.

3. The mass spectrometer of claim 1, wherein the ion interface device is formed as an integrated structure comprising the transport/collision section and a distribution section.

4. The mass spectrometer of claim 1, wherein the at least one pulsed mass analyzer includes a time-of-flight (TOF) mass analyzer.

5. The mass spectrometer of claim 1, wherein the ion interface device includes a distribution section having an array of rod electrodes each extending transversely to a longitudinal axis of the ion interface device, and the confinement cells are disposed laterally outwardly of the rod electrodes.

6. The mass spectrometer of claim 5, wherein at least a portion of the rod electrodes are segmented, and further comprising a DC voltage source for applying DC offsets to the rod electrode segments to establish a transverse DC field of controllable direction to cause ion packets to pass to a selected one of the plurality of confinement cells.

7. The mass spectrometer of claim 1, wherein the plurality of confinement cells are arranged such that ions directed to at least one of the confinement cells pass through another one of the confinement cells.

8. The mass spectrometer of claim 1, wherein the ion trap comprises a two-dimensional quadrupole ion trap configured for orthogonal mass-selective ejection of ion packets.

9. The mass spectrometer of claim 1, wherein the ion trap comprises a two-dimensional quadrupole ion trap configured for axial mass-selective ejection of ion packets.

10. The mass spectrometer of claim 1, wherein the product of the ion confinement period and a pressure within the confinement cell is at least 1 ms·mTorr.

11. The mass spectrometer of claim 4, wherein the TOF mass analyzer includes a first flight path having an entrance region positioned proximate to a first set of confinement cells, and a second flight path having an entrance region positioned proximate to a second set of confinement cells.

12. The mass spectrometer of claim 11, wherein the first and second flight paths terminate at a common detector system.

13. The mass spectrometer of claim 1, wherein each ion packet consists of ions having a range of mass-to-charge ratios that is narrow relative to the mass-to-charge ratios of the initial ion population within the ion trap.

14. A method of performing mass spectrometry analysis, comprising:

storing ions in an ion trap;

ejecting first and second packets of ions from the ion trap in temporal succession;

providing an ion interface device having a transport/collision section and a plurality of spatially separate confinement cells, the plurality of confinement cells including first and second confinement cells;

receiving a first ion packet in the ion interface device, fragmenting or reacting at least a portion of the ions in the transport/collision section, and routing the first ion packet to the first confinement cell;

concurrently with confinement of the first ion packet in the first confinement cell, receiving a second ion packet in the ion interface device, fragmenting or reacting at least a portion of the ions in the transport/collision section, and routing the second ion packet to the second confinement cell; and releasing each ion packet to a pulsed mass analyzer after the packet has been confined in the ion confinement cell for a prescribed confinement period, wherein the first and second confinement cells release ions to a common pulsed mass analyzer;

wherein the first packet of ions is routed to the first ion confinement cell without passing through the second confinement cell, and further wherein the second packet of ions is routed to the second confinement cell without passing through the first confinement cell.

15. The method of claim 14, wherein the ion interface device includes at least four confinement cells.

16. The method of claim 14, wherein the product of the cooling period and a pressure within the confinement cell is at least 1 ms·mTorr.

17. The method of claim 14, wherein each ion packet consists of ions having a narrow range of mass-to-charge ratios relative to the initial population of ions in the ion trap.

18. The method of claim 14, wherein the pulsed mass analyzer is a time-of-flight mass analyzer.

* * * * *